US005259804A

United States Patent [19]

Plow et al.

[11] Patent Number: 5,259,804

[45] Date of Patent: Nov. 9, 1993

[54] SAIL SLIDABLE ON GUIDE LINES

[76] Inventors: Gregory Plow, 353-C E. 10th St. Suite 730, Gilroy, Calif. 95020; James Palmer, 41 Greenview St., Apt. 1108, Santa Cruz, Calif. 95060

[21] Appl. No.: 921,934

[22] Filed: Jul. 29, 1992

[51] Int. Cl.[5] ..... A63H 33/40

[52] U.S. Cl. ..... 446/176; 446/489; 446/490

[58] Field of Search ..... 446/176, 217, 218, 30, 446/230–232, 228, 229, 489–491; 244/153 R, 155 R; 273/85 F, 319, 330, 413, 414, 331, 459

[56] References Cited

U.S. PATENT DOCUMENTS 2,634,127 4/1953 Shapiro ..... 446/228 X 3,006,586 10/1961 Strelakos, Jr. ..... 244/155 R 3,893,256 7/1975 Wolf et al. ..... 273/413 X

*Primary Examiner*—Mickey Yu

*Attorney, Agent, or Firm*—Jeffrey A. Hall

[57] ABSTRACT

A toy having a first and a second guide line support, each guide line having two ends and a handle member respectively secured at each end. A body member for operating aerodynamically includes a frame, a sail, and spaced fasteners which are also secured to the first and to the second guide lines. In one embodiment support elements are slideably secured to the body member and to the fasteners for supporting the body in a desired orientation between the first and second guidelines. Alternatively, the support members may be included as a part of the frame of the body member.

4 Claims, 2 Drawing Sheets

SAIL SLIDABLE ON GUIDE LINES

BACKGROUND OF THE INVENTION

1. Field of Invention

This invention relates to flying toys, and more particularly wind driven flying toys having multiple guidelines and capable of reversing direction of flight by rotation of handles attached to the guide lines.

2. Description of the Prior Art

Numerous toys and flying apparatuses have been proposed and developed for fun and entertainment, educational purposes, and competition. Flying toys attached to strings such as kites have been used and enjoyed for centuries. More recently a number of aerodynamic toys to be thrown in the air for use in throwing games have become very popular. For example, U.S. Pat. No. 3,359,678 shows a flying saucer; U.S. Pat. No. 3,976,295 shows a tethered disc enabling retrieval if the disc does not make it back to the operator in the course of its flight; U.S. Pat. No. 4,516,946 shows a flying disc construction having an annular roller bearing at its center; and U.S. Pat. No. 4,802,875 showing a tethered flying disc with a two-piece bearing for control of the disc on a support line.

A number of kite string toys and flying devices have been described in the previous literature. Representative examples of issued patents are U.S. Pat. No. 1,172,198, U.S. Pat. No. 2,041,233, and U.S. Pat. No. 3,752,424. All of these devices required manual reset before the device could climb the kite string again before the dive down action. U.S. Pat. No. 4,805,853 provided a modification of this type of device by having means to adjust elevator tabs at the rear wing tips of the device and included a parachute launching mechanism.

Another genre of prior art flying toy using guide lines is disclosed in U.S. Pat. No. 518,931 where a toy is shown in which the inclination of the guide lines can be reversed while U.S. Pat. No. 2,388,513 shows the use of a line connected to a toy air plane on a line to effect the release of toy bombs. U.S. Pat. No. 3,838,855 disclosed a toy air plane carried by a support line connected to a fixed reel, and U.S. Pat. No. 4,522,605 shows a toy operable over an inclined guide line extending between two fixed supports and runs over fixed support eye to a freely held reel with handle extensions.

The term "prior art" as used herein or in any statement made by or on behalf of applicant means only that any document or thing referred to as prior art bears, directly or inferentially, a date which is earlier than the effective date of this application.

SUMMARY OF THE INVENTION

The present invention provides an exciting, high speed, and smooth working flying toy capable of being wind driven in both directions on multiple lines. The toy of the present invention may be controlled by the user or users in a variety of ways not previously available. The direction of flight of the toy may be reversed simply by rotating the handles transversely 180 degrees, and the sail pitch adjustment may be varied and controlled by varying the distance between guidelines.

To accomplish these and other objects and advantages a flying toy, in one embodiment, comprises a first and a second guide line member. Each guide line has two ends and each end includes a handle secured thereto. The handle may, at each end of the guide lines, connect both guide lines, or a separate handle may be provided for each end of each guide line. A body member for operating aerodynamically includes a frame and a sail element. Fasteners are secured to the frame and to the guide lines, or may be integral with the frame. In one embodiment, support elements are secured to the body member and to the fasteners for supporting the body member in a desired orientation between the first and the second guide line. Alternatively, the frame may be configured to provide the support of the body member in a desired orientation between the first and the second guide lines.

It is therefore a principal object of the present invention to provide a flying toy which is wind driven in both directions, runs on multiple guide lines, and reverses directions by rotating the handles 180 degrees transversely.

A further object of the present invention is to provide a flying toy in which control of the sail pitch adjustment is allowed by varying the width of the guide lines in relation to one another thereby controlling the pitch of sail, or by repositioning the sail element within an independent rigid frame.

A still further object of the invention is to provide a flying toy which may be flown using either a horizontal, vertical, or other angular orientation of the guidelines and may be used by one or two participants.

Further objects and advantages of the invention will become apparent from a consideration of the ensuing description and the accompanying drawings.

DESCRIPTION OF THE PREFERRED EMBODIMENTS

Figure 1:
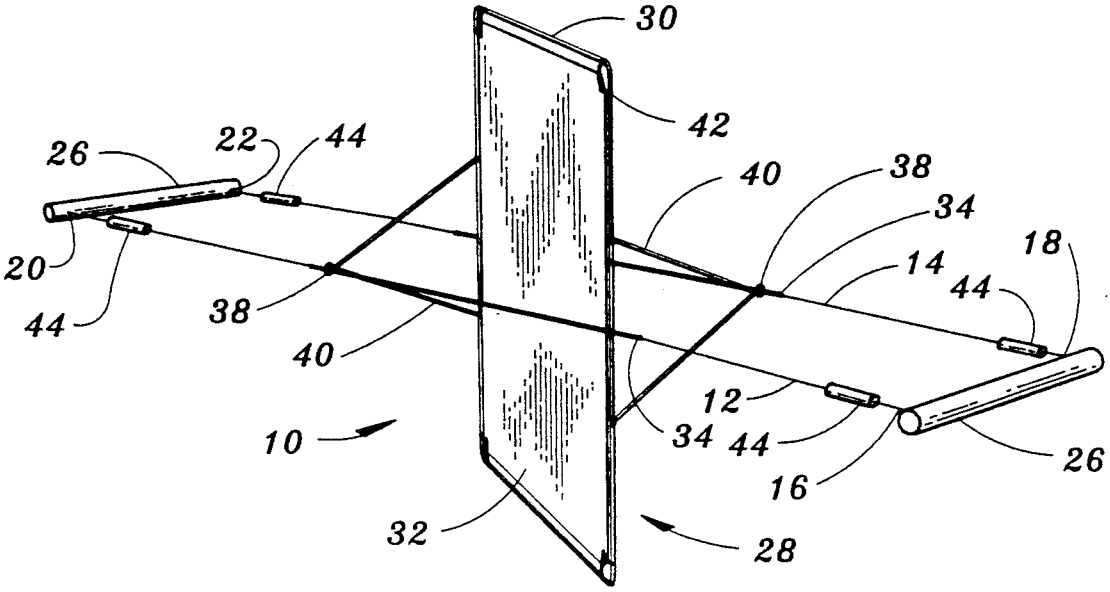
FIG. 1 shows a front perspective view of a flying toy according to the invention.
Figure 2:
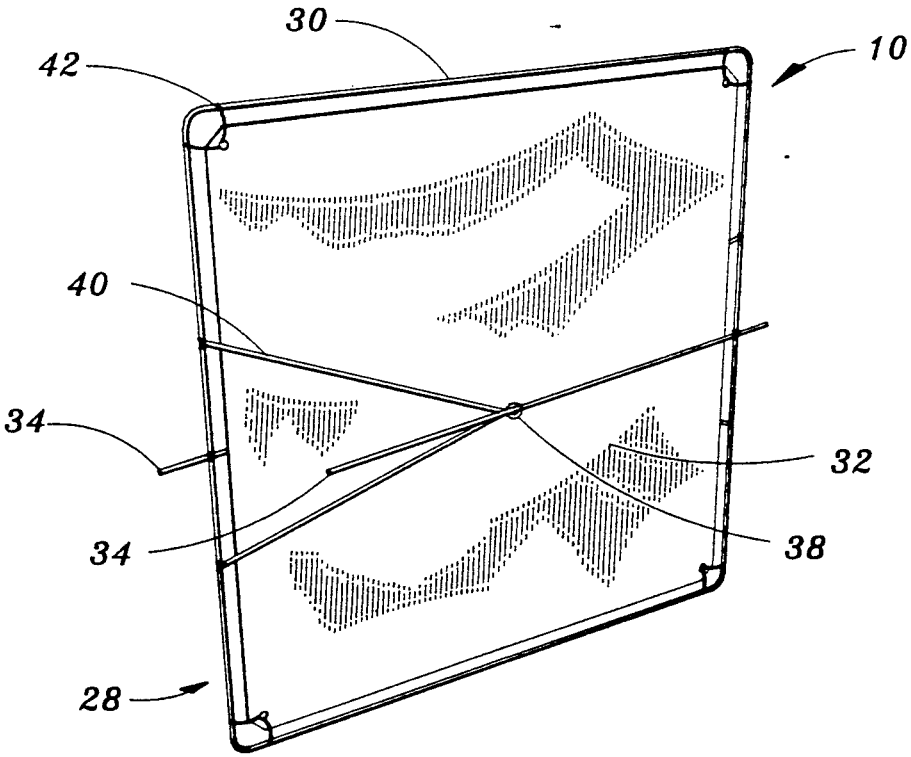
FIG. 2 shows a perspective view of such flying toy in a partially folded condition, illustrating the operation of support elements 40 and fasteners 34, according to the invention.

FIGS. 1 and 2 show a flying toy 10 according to a preferred embodiment of the invention. The toy 10 comprises a first guide line 12 having a first end 16 and a second end 20, and a second guide line 14 having a first end 18 and a second end 22. The first and second guide lines are preferably made out of monofilament fishing line, however, a cord, wire, string, or the like, may be substituted for the fishing line material. A handle 26 is secured to both ends of the first and second guideline and may be either one piece, where one hand of a user controls one of both guide lines with a single handle, or alternatively, a handle for each hand of the user may be provided so that each hand of a user controls one end of a guide line, or handles may be eliminated altogether and the users simply grasp or wrap ends 16, 18, 20, and 22 in third hands. A shock tube 44 composed of compressible material is preferably secured to the guidelines near ends 16,18,20, and 22 to prevent discomfort or injury to the user.

A body member 28, preferably comprises a frame 30 and a sail element 32 secured to the frame. The frame is preferably composed of rigid carbon graphite tubes, however, any lightweight rigid, durable material such as fiberglass rods, wood dowels, aluminum or metal alloy tubes, plastic tubes, rods, or the like, or alternatively one piece moulded designs may be used. Sail 32 is preferably composed of a ripstop nylon cloth, however, any durable resilient material may be substituted for such material, such as TYVEK, mylar, foil, paper, plastic, cloth, rubber, foam sheeting or the like, and may include battens therein. The sail may be secured to frame 30 by cord 42, or by O-rings, shock cords, wire, string, rubber bands, adhesive, or any other conventional fastening device, or fastened directly thereto. However, frame 30 may be eliminated if more than two guidelines are used and sufficiently rigid sail material utilized. The toy shown in FIGS. 1 and 2 has a rectangular frame and sail configuration, while the embodiment shown in FIGS. 3 and 4 has an octagon configuration. Any shape or configuration of frame and sail may be used for body member 28, for example, triangular, pentagon, circular, etc. Body member 28 is preferably pivotally attached to guidelines 12 and 14 by fastening elements 34 shown in FIGS. 1 and 2 as elongated tubular members 34 through which guide lines 12 and 14 pass through, however, body member 28 may be secured to guide lines 12 and 14 by a plurality of eyelets 36, a plurality of split ring fasteners 38, roller bearings, or any other mechanical fastener capable of slideably securing body 28 to guide lines 12 and 14.

Support elements 40 are shown in FIGS. 1 and 2 and are slideably connected to tubular fastener 34. Support elements 40 may be slid down frame 30 or detached when toy 10 is to be packed, stored, or transported and toy 10 folds up into a flat easily carried or stored configuration. To re-open, support elements 40 are slid up or reattached to frame 30 and toy 10 is ready again for use. Support element 40 may be built as a part of frame 30 or as an independent element. In use, support elements 40 may be adjusted to control the angle of sail 32 within guide lines 12 and 14 by sliding the supports either up or down frame 30. Alternatively, other embodiments such as those shown in FIGS. 3 and 4, will not include support elements 40, instead, frame 30 will be constructed, for example, out of tubular fiberglass flexible rods and support body 28 thereby in a desired orientation between guide lines 12 and 14, with frame/sail connection 42 allowing sail pitch adjustability.

Figure 3:
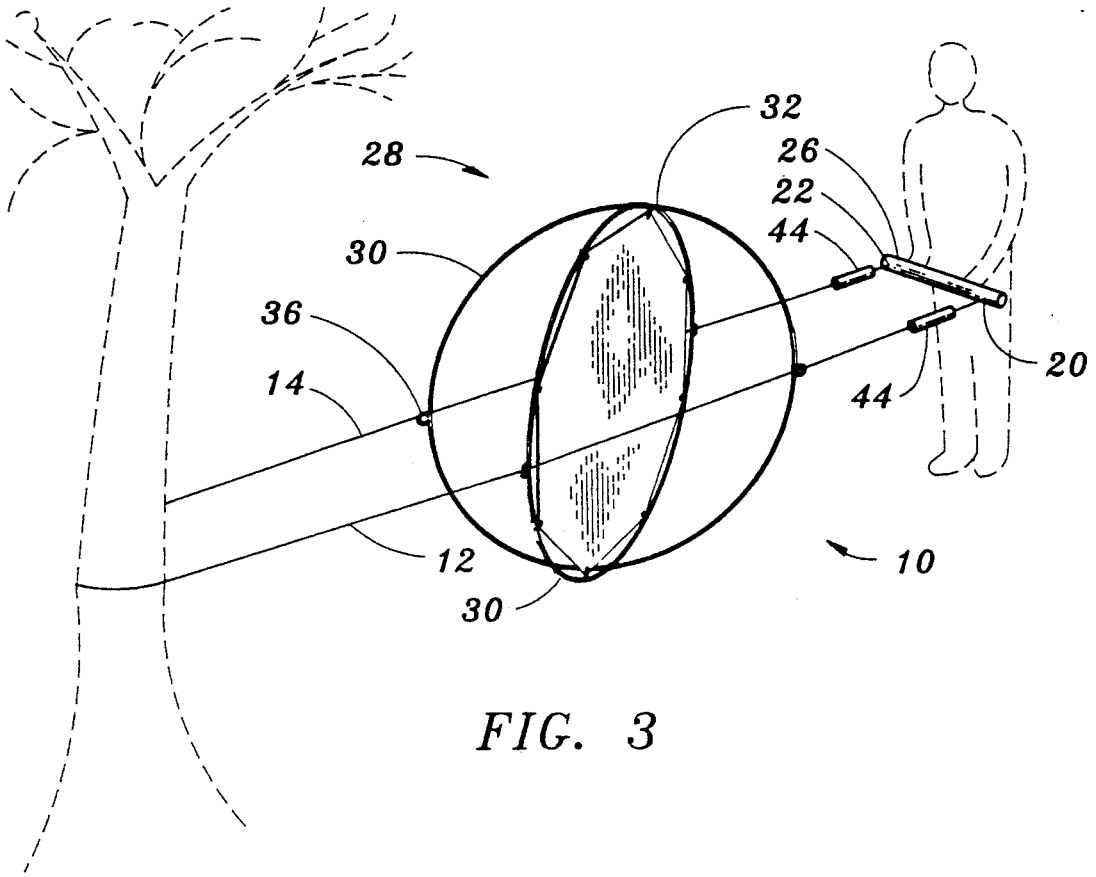
FIG. 3 shows a front perspective view of a flying toy with a spherical frame and octagon sail, according to another embodiment of the invention.
Figure 4:
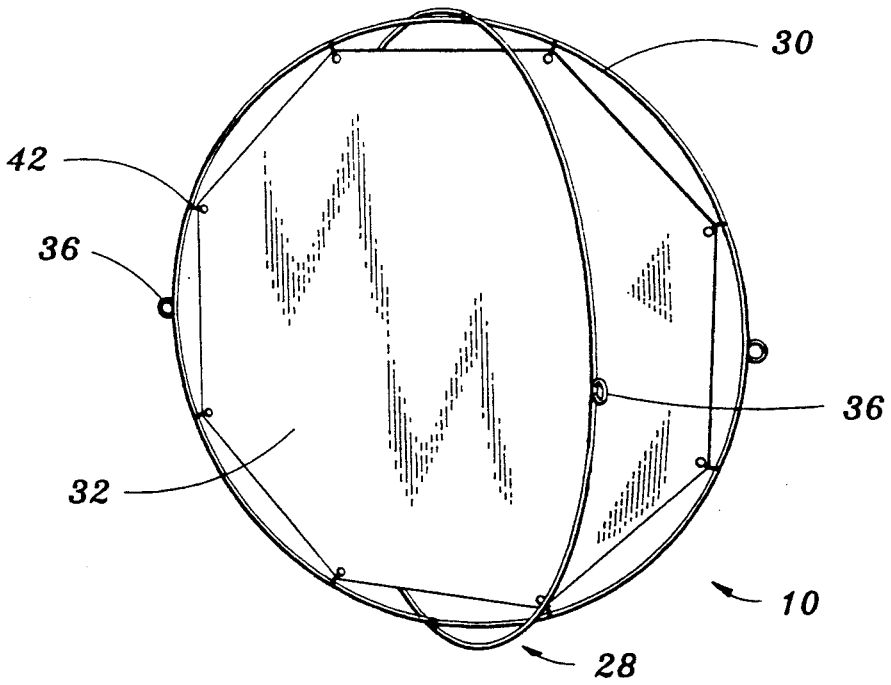
FIG. 4 shows an end view of the embodiment illustrated in FIG. 3, according to the invention.

Referring now specifically to FIGS. 3 and 4 an alternative embodiment of flying toy 10 is illustrated. The embodiment shown in FIGS. 3 and 4 has a sail 32 with an octagon configuration. In this embodiment it is preferable to use eyelets 36 to secure frame 30 to guide lines 12 and 14, however, as with the embodiment shown in FIGS. 1 and 2 alternative fasteners such as split ring fasteners, roller bearings, or the like may be utilized. The configuration of sail 32, although shown as an octagon in FIGS. 3 and 4 may be any shape, for example, spherical, triangular, pentagonal, or novelty shapes such as animal, fish cartoon characters, artistic designs, and the like.

For embodiments of flying toy 10 such as illustrated in FIGS. 3 and 4 which utilize a spherical frame configuration, frame 30 is preferably constructed out of flexible, durable material such as fiberglass flexible rods, tubular metal, or plastic. For ease of assembly and disassembly shock cord linkers/connectors may be used within the frame members as well as with the embodiment illustrated in FIGS. 1 and 2. As with the embodiment shown in FIGS. 1 and 2, the embodiment shown in FIGS. 3 and 4 is capable of use with a horizontal or vertical line orientation, frame and sail direction may be reversed on the guide lines by simply rotating handles 26 by 180 degrees. It may be used by one or two participants, and sail pitch adjustments can be made by varying the relative width of guide lines 12 and 14 to one another, as well as manipulating the frame/sail connection 42.

In operation and use flying toy 10 may be used by either one or two users. Flying toy 10 is very simple to assemble, use, disassemble, and store. The user, to assemble the embodiment shown in FIGS. 1 and 2, simply slides support elements 40 to an open position, extends guide lines 12 and 14, and then each participant takes hold of a handle. To control frame 30 and sail 32 on guide lines 12 and 14 the user simply rotates handle 26 180 degrees transversely to the guidelines thereby reversing sail angle and flying toy 10 reverses direction. In this way when flying toy 10 reaches one end of the guide lines the user at that end rotates handles 26 and the toy glides down guide lines 12 and 14 to the other user's end. If each end of guide lines 12 and 14 are supplied with two handles instead of one the user's may also control the sail pitch by varying the width or height of guide lines 12 and 14 in relation to one another.

If support elements 40 are used, such as illustrated in FIGS. 1 and 2, the angle and orientation of sail 32 may be adjusted by sliding the supports up or down frame member 30. Flying toy 10 maybe used for play, competition, racing, educational activities, stunts, and the like. Because of the unique control of the sail and frame possible with the present apparatus numerous activities are possible beyond simply flying the toy, such as picking up objects, sending messages between users, configuring sail 32 as a plane and sending cargo or dropping play bombs, or the like.

While the above description contains many specificities they should not be construed as limitations on the scope of the invention, but merely as exemplifications of preferred embodiments thereof. Those skilled in the art will envision many possible variations are within its scope. For example, the dimensions and shapes of the various embodiments may be altered, or alternative materials used to construct the frame, sail, and connectors. The guide lines may be provided in a vertical, horizontal orientation, or incremental orientations other than true horizontal or true vertical, and various materials may used for the guide lines. These and other variations may be made and still be within the scope of the invention. Accordingly, the scope of the invention should be determined by the appended claims and their legal equivalents, and not limited by the examples which have been given.

We claim:

1. A wind driven flying toy, comprising:

a first and a second guide line member, said first and said second guide line member each having two ends and including handle means secured at each end, a body member for operating aerodynamically having a frame and a sail element secured to said frame, means for fastening said body member to said first and to said second guide line member, and means for supporting the body member in a desired orientation between said first and said second guide line.

2. The flying toy of claim 1 wherein said means for fastening said body member to said first and said second guide line member comprises a pair of elongated tubular elements secured to said body member and slideably engaged to the first and to the second guide line member.

3. The flying toy of claim 1 wherein said means for fastening said body member to said first and to said second guide line member comprises a plurality of eyelet fasteners.

4. The flying toy of claim 1 wherein said means for fastening said body member to said first and to said second guide line member comprises a plurality of split ring fasteners.

* * * * *